United States Patent [19]

Raber et al.

[11] Patent Number: 4,794,398

[45] Date of Patent: Dec. 27, 1988

[54] MULTIMODE, MULTISPECTRAL SCANNING AND DETECTION

[75] Inventors: Peter E. Raber, Milford; Lester H. Kosowsky, Stamford, both of Conn.

[73] Assignee: United Technologies Corporation, Hartford, Conn.

[21] Appl. No.: 913,890

[22] Filed: Oct. 1, 1986

[51] Int. Cl.[4] ..... H01Q 19/06; H01Q 15/08

[52] U.S. Cl. ..... 343/754; 343/911 R

[58] Field of Search ..... 343/725, 753, 754, 757, 343/815, 909, 911 R, 912

[56] References Cited

U.S. PATENT DOCUMENTS

| | | | |
|---|---|---|---|
| 2,887,684 | 5/1959 | Dexter et al. | 343/753 |
| 3,255,451 | 6/1966 | Wolcott | 343/754 |
| 3,255,453 | 6/1966 | Horst | 343/754 |
| 3,979,755 | 9/1976 | Sandoz et al. | 343/872 |
| 4,194,209 | 3/1980 | Colburn, Jr. | 343/753 |
| 4,480,254 | 10/1984 | Spencer et al. | 343/754 |

*Primary Examiner*—William L. Sikes
*Assistant Examiner*—Doris J. Johnson

[57] ABSTRACT

In a multimode or multispectral electromagnetic detection system (11), a pair of rotatable scanning prisms (13' and 13''), each of said prisms comprising at least a pair of cooperative subprisms (13'*a*, 13'*b*, 13''*a* and 13''*b*), and the cooperative materials of the subprism being selected so as to ensure that electromagnetic radiation passing through the pair of rotatable prisms is equally deviated in a transverse direction.

5 Claims, 3 Drawing Sheets

MULTIMODE, MULTISPECTRAL SCANNING AND DETECTION

CROSS REFERENCE TO RELATED APPLICATIONS

The subject matter of this application is related to the subject matter of commonly-owned U.S. Pat. application Ser. Nos. 800,937 entitled "Multimode, Multispectral Antenna" 800,938 entitled "Multimode, Multispectral Antenna" filed on Nov. 22, 1985 913,898 "Multispectral Radome for Radar and IR" and 913,899 entitled "Multimode, Multispectral Scanning and Detection", entitled "Multispectral Radome" and "Multimode, Multispectral Scanning and Detection", respectively, filed on even date herewith which are expressly referenced to and incorporated herein by such reference.

TECHNICAL FIELD

This invention is directed toward the art of multimode frequency and wavelength scanning and detection systems, and more particularly, toward airborne multimode scanning and detection systems employing radar, visible and/or infrared scanning and detection techniques.

BACKGROUND ART

Many different kinds of multimode scanning and detection systems are currently known. Such systems may be active or passive in operation, being operationally effective in scanning or detecting multiple beams of radiation at multiple frequencies and wavelengths. The frequencies of operation include infrared radiation, in which heat is detected to identify a particular target or target region. Detection may be accomplished in the radar or radio frequency bands, either actively or passively or subject to a combination of active and passive modes.

The term multimode can further be taken to refer to detection first at one mode of energy operating at a given first frequency, and then detection at another selected mode or frequency. When several frequencies of the electromagnetic spectrum are thereby used, this approach is frequently referred to as multi-spectral. Multimode can further be taken to mean the use of both active and passive bands of radiation. It can additionally mean the use of one or more radar bands of radiation and one or more infrared bands. Multimode detection systems can moreover be ground based, ship based, airborne or set aloft in space.

In general, multimode detection systems enhance the detection flexibility and effectiveness of the system using the technique. For example, one beam may be designed to be wide in shape in order to conduct search operations for a target sought, and the other beam working in conjunction therewith is then narrow in order to accomplish tracking once the target has been identified. The different modes can relate to the distance or range of detection as well. For example, one mode can be used for short range target acquisition, while the other mode is employed at more extended ranges. For example, radar frequencies might be used at long ranges and infrared frequencies closer in.

The various modes of operating such detection systems can moreover be used in combination with each other in order to accomplish effective target classification and identification. For example, targets often appear different in different spectral regions, and the degree of difference can be used to distinguish one type of target from another.

As desirable as multimode systems may be, problems nonetheless arise in the development of multimode systems due to the relationships between the modes. For example, techniques and arrangements have been urgently needed to establish coordination between the modes of radiation selected, to permit effective handoff between the modes of operation to ensure a continuity of information and operation. Other problems faced in implementing multimode systems are caused by the limited nature of refractive materials available for use as protective domes, collimating lenses, and the scanning system itself, in order to permit unhampered egress and ingress of the selected beams of radiation to be scanned or detected.

The prior art often achieves beam scanning by mechanical pointing means, for example, by mounting entire antenna systems on gimbals. Such methods are more costly, cumbersome and prone to breakdown than the rotating refractive prism scanners according to the invention herein.

Other difficulties arise in designing an effective multimode scanning arrangement with rotating prisms when the beams scanned are at different frequencies, because beams of different frequencies typically are not deviated by the same amplitude. This not only causes such beams to point in different directions from time to time, but it also causes the difference in these directions to change by an amount which depends upon the pointing direction, thereby hampering transfer from one mode of operation to the other. In other words, because the same scanning prisms are utilized for both beams, handoff from one mode to the other becomes more difficult to accompiish.

DISCLOSURE OF THE INVENTION

The invention herein is accordingly directed toward the establishment of a scanning arrangement for a multimode, multispectral detection system having beams of several frequencies which scan by the same amount. When the beams are optically superimposed, they are then pointed in the same direction and may be directed toward a selected target simultaneously, thereby enabling straightforward handoff between modes of operation.

In particular, the scanning arrangement includes a circumferentially rotatable pair of scannng prisms, each of the scanning prisms being constructed of cooperative subprisms of selected apex angle and materials, thereby ensuring that the parallel beams of radiation which enter the scanning prisms will also exit the prisms parallel to each other, and will thereby be directed toward the same target area or region in unison.

Other features and advantages of the invention will be apparent from the specification and claims and from the accompanying drawings which illustrate an embodiment of the invention.

BEST MODE FOR CARRYING OUT THE INVENTION

Figure 1:
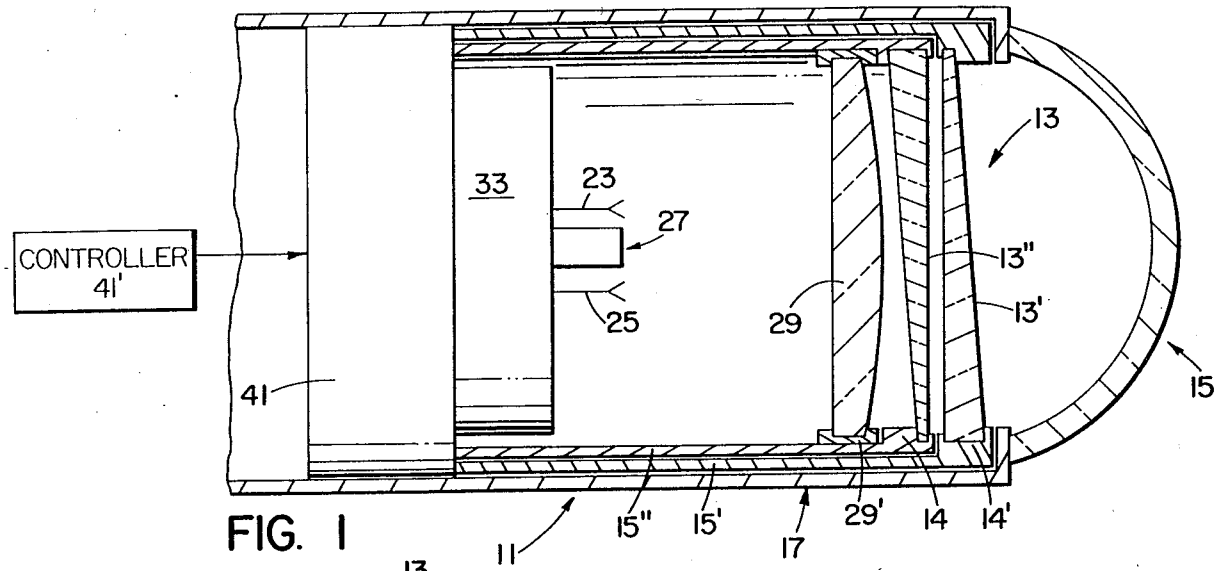
FIG. 1 shows in axial cross section, a multimode detection system addressed herein.

FIG. 1 shows generally a possible application for using a multimode detection system 11 including a scanning arrangement 13 having cylindrical prisms 13' and 13''. The detection system 11 particularly includes a radome 15 for passing beams of electromagnetic radiation operating in selected modes and/or frequencies including for example millimeter wave or Ku-band radar frequencies and infrared or visible frequencies. The detection system 11 further includes tubular walls 17 for containing electronic and optical equipment used for operating a detection system 11 and for acquiring and monitoring one or more selected external targets of interest and holding scanning prisms 13 and radome 15 in place. The detection system 11 further includes, according to a preferred embodiment of the invention, an infrared sensor element 27 and a pair of radar feeds 23 and 25 suitably mounted with respect to a support structure 33 of arrangement 11 which holds infrared sensor element 27 and feeds 23 and 25 in place within walls 17, as will be seen. Beams of radiation progressing to and/or from respective sensors 23, 25, and 27 pass through collimating and shaping lens 29 and are scanned by firtt and second scanning prisms 13 and 13'.

As will be seen, scanning can be accomplished in an upward and downward direction, laterally back and forth, circularly, or in any one of a number of complex scan patterns, which can be programmed into a controller 41' suitably mounted in arrangement 11. The scanning prisms 13 eliminate the need for gimbals. Instead, they can be driven by a drive mechanism 41 acting under direction of controller 41', which operates mechanically for example with axially rotatable cylinder means 15' and 15'' suitably rotatably seated within walls 17 and drivingly individually engaged to drive 41 either peripherally or flangedly along the surface of the circumference of the respective scanning prisms 13 and 13', or otherwise through an axially directed drive (not shown) extending to the center of the scanning prisms and then in turn through the collimating or shaping lens 29.

FIG. 1 further shows the collimating lens 29 held in place flangedly in a holding structure 29' which is in turn mounted on rotatable cylinder means 15'' for example, according to one version of the invention. Further, the scanning prisms 13' and 13'' are respectively secured and mounted in similar flanged structures 14' and 14 which as already noted are mounted on rotatable cylinder means 15' and 15'' which are in turn suitably mechanically coupled to the drive mechanism 41.

Figure 2A:
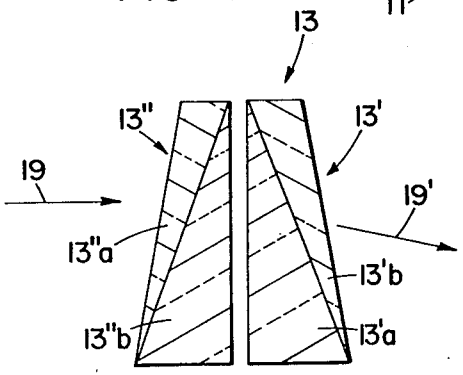
FIGS. 2A and 2B show respective cross sections of a dual frequency scanning arrangement according to the invention herein, first with the arrangement set at maximum net angular deviation and then with no net angular deviation.

FIG. 2A shows a cross-section of a preferred version of the scanning arrangement 13 according to one embodiment of the invention herein. Scanning prisms 13' and 13'' are preferably cylindrical and rotatable about an axis parallel to input ray 19. In FIG. 2A, scanning prisms 13' and 13'' are relatively rotated and disposed to reorient the direction of input beam 19 in the direction of output beam 19'. If an input beam 19 is at another selected frequency, it will nonetheless be deflected in the same fashion and to the same extent as beam 19 of a first selected frequency, because of the inventive feature of each of the prisms, namely that the subportions **13'*a* and 13'*b* and 13''*a* and 13''*b*** of the respective prisms are cooperative. In particular, if what the first subportion does is greater for one frequency than for the other, this is undone by the cooperative subportion to precisely the same extent.

Figure 2B:
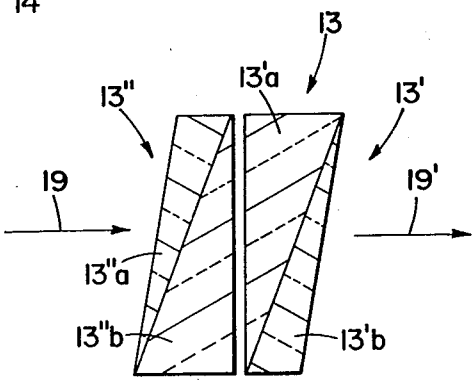

In FIG. 2B, a selected input beam 19 of electromagnetic radiation at a selected frequency passes directly through both scanning prisms 13' and 13'' without any net angular deviation, since the second prism 13' reverses the deviation produced by the first prism 13'' completely at the particular orientation to which it has been set.

Figure 3A:
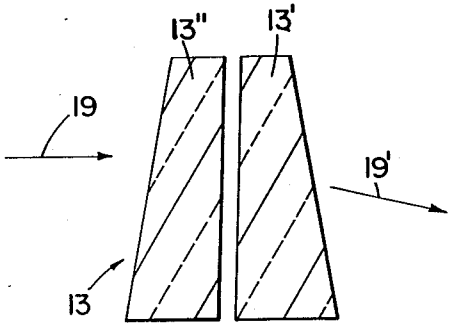
FIG. 3A PRIOR ART
FIGS. 3A and 3B show a scanning arrangement according to the prior art.
Figure 3B:
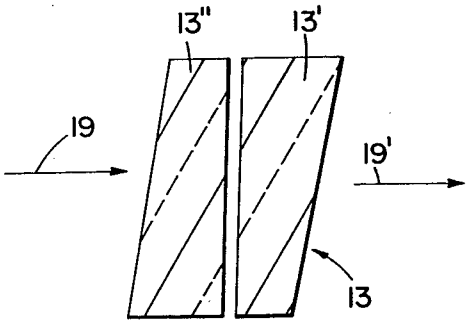
FIG. 3B PRIOR ART

The arrangement set forth in FIGS. 2A and 2B is an advance over the known prism systems of FIGS. 3A and 3B which display no subprisms.

Figure 4:
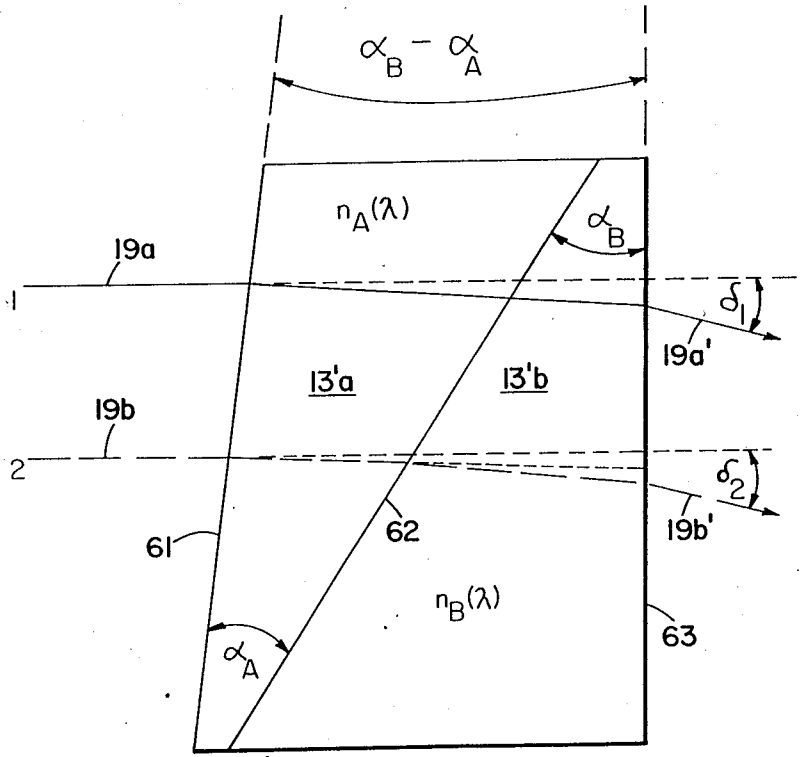
FIG. 4 shows first and second beams of radiation having different wavelengths passing through a representative cross section of a scanning prism.
Figure 5:
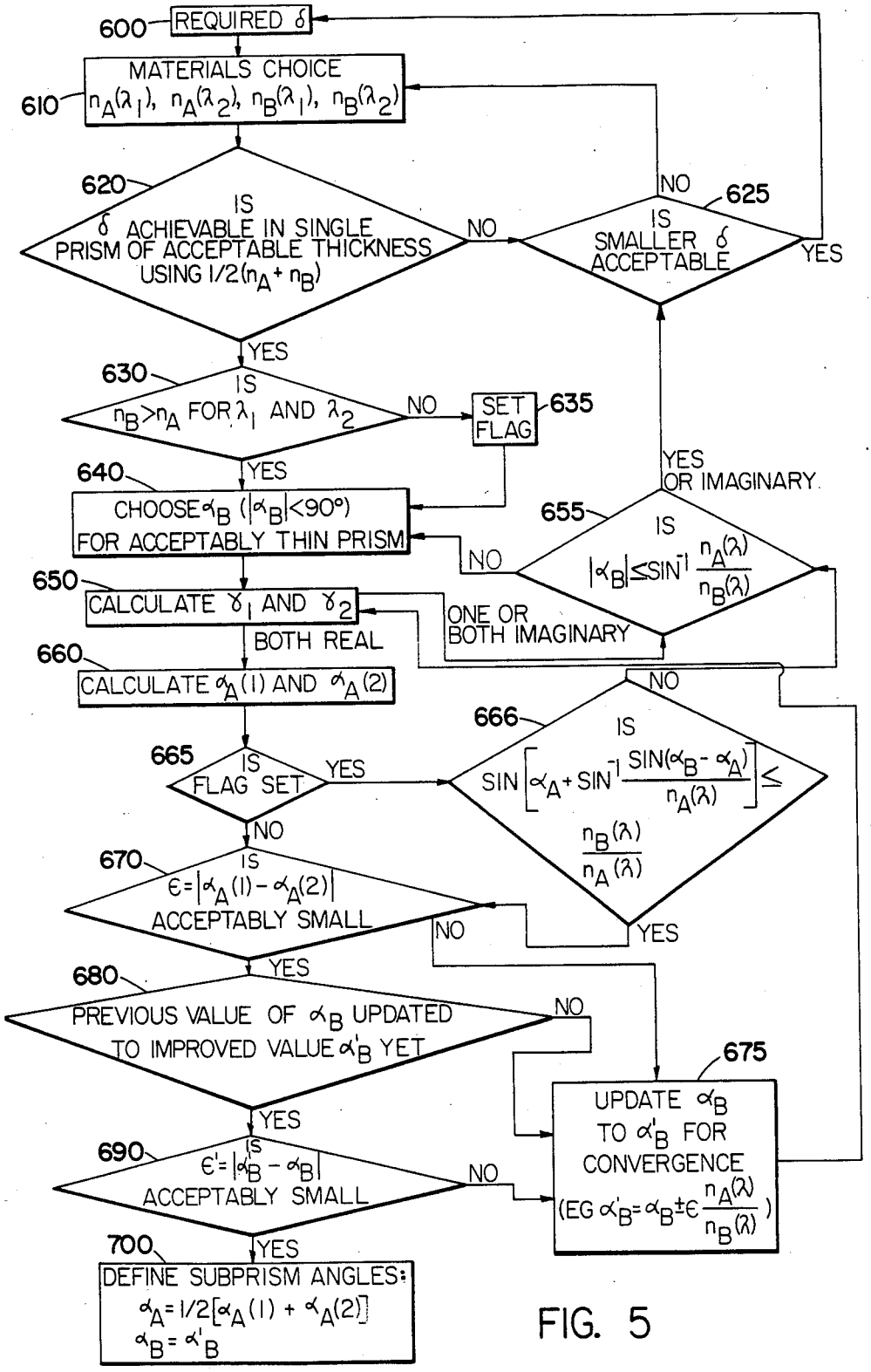
FIG. 5 is a flow chart indicating how to determine materials and apex angles according to the invention herein.

FIG. 4 shows in detailed cross section one of the two scanning prisms 13' for example according to the invention herein, respectively depicting two subprisms **13'*a* and 13'*b* of respective first and second materials A and B. For convenience in analysis, first and second beams 19*a* and 19*b* of electromagnetic radiation of two selected frequencies and wavelengths are shown axially incident upon cylindrical prism 13'**. The selected materials are respectively alumina and zinc sulfide for example.

In general, optical materials are characterized not only by different indices of refraction, but also by different degrees of variation of index with frequency and wavelength. Thus, for example, it is possible for two materials to each have the same refractive index at one wavelength, but different refractive indices at another.

A beam of electromagnetic radiation 19 is refracted at a surface through which it passes in proportion to the sine of its angle from the normal to that surface, and in proportion to the ratio of the refractive indices of the respective materials on opposite sides of the surface.

This concept establishes the operational basis for the cooperative multiprism assembly 13' shown in FIG. 4, in which the material of subprism A has apex angle "$alpha_a$" and a refractive index "$n_a$" as a function of wavelength lambda, while the material of subprism B has apex angle "$alpha_b$" and a refractive index "$n_b$" which again is a function of wavelength lambda. If the external medium is air or space, its refractive index is essentially unity for all wavelengths of interest.

Output deviation angles $d_1$ and $d_2$ correspond to wavelengths $lambda_1$ and $lambda_2$ respectively, and are equal to the net deviation after refraction by the three surfaces through which the radiation passes.

Without loss of generality, one design procedure for equalizing output angles $d_1$ and $d_2$ is possible by setting $n_a$ ($lambda_1$)$=n_b$ ($lambda_1$) and ensuring that $n_a$($lambda_2$)$<n_b$($lambda_2$)$<n_a$ ($lambda_1$), while the initial directions of the input beams 19 are perpendicular to surface 63, and are therefore incident on surface 61 at the angle $alpha_b-alpha_a$ from the normal to that surface. For $lambda_1$, refraction occurs at the first surface such that the sine of the refracted angle is proportional to sine ($alpha_b-alpha_a$)/$n_a$($lambda_1$), and the ray accordingly continues undeviated by surface 62, (because $n_a=n_b$ for this wavelength), until it reaches surface 63, at which it is further refracted to the net deviation angle $d_1$.

For $lambda_2$, the first surface refraction is less than for $lambda_1$, since $n_a$ ($lambda_2$)<$n_a$ ($lambda_1$). However, when this ray reaches surface 62, it is further refracted, because now $n_b$ ($lambda_2$)≠$n_a$ ($lambda_2$), and the amount of this refraction is controlled by both the ratio of these indices and by the magnitude of $alpha_b$.

Since the values of $n_a$ ($lambda_2$) and $n_b$ ($lambda_2$) are known, the angle $alpha_b$ can be chosen so that the refracted $lambda_2$ ray reaches surface 63 at the incident angle $\sin^{-1}[\sin d_1]/n_b(lambda_2)]$. The exit angle $d_2$ must then be equal to $d_1$.

An example of a preferred version of the invention is to fashion subprism A, i.e., subprism 13'(a), out of an alumina-like material having refractive index of about 3 in the radar region of the electromagnetic spectrum, and a refractive index of about 1.7 for the IR region. Subprism B may be made of a material such as zinc selenide, which also has a refractive index approximately equal to 3 in the radar region, but which has an IR index of about 2.4. Then for the radar region $lambda_1$, a choice of $alpha_b-alpha_a=5$ degrees would result in $d_1=10.05$ degrees. In order to make $d_2=d_1$, this would require a beam angle for $lambda_2$ within subprism B, i.e., subprism 13'(b) equal to 4.17 degrees from the normal to surface 63, while the angle of the same ray within subprism A would be 2.94 degrees from the normal to surface 61, or 2.06 degrees down from its original external direction. Since its original direction was perpendicular to surface 63, this means that the ray must be deviated an additional 2.11 degrees by surface 62. Ray tracing shows that since the ratio of refractive indices at surface 62 is 1.7:2.4, that surface must be tilted clockwise 9.27 degrees from the axis in order to produce this result. This example would therefore require $alpha_a=4.27$ degrees and $alpha_b=9.27$ degrees. By way of additional clarification, it should be noted that FIG. 4 depicts the circumstance in which "$n_b$" is greater than or equal to "$n_a$". The concept, however, is equally valid for "$n_b$" less than "$n_a$". Further, angles "$alpha_a$" and/or "$alpha_b$" could be negative angles as well under the inventive concept.

With respect to FIG. 4, the output angle of deviation "d" for a given wavelength lambda is: "d"$=\sin^{-1}[n_b$(lambda) sin [$alpha_b-\sin^{-1}[[n_a(lambda)/n_b(lambda)]$-sin[$alpha_a+\sin^{-1}(\sin(alpha_b-alpha_a)/n_a(lambda))]]]]$. This equation shows that "d" is imaginary (e.g. due to total internal reflection) unless $[n_a(lambda)/n_b(lambda)]$ sin[$alpha_a+\sin^{-1}[\sin(alpha_b-alpha_a)/n_a(lambda]]$ is less than or equal to one. This condition can always be met when $n_b(lambda)$ is greater than or equal to $n_a$(-lambda), but it can be met only for a specific range of values when $n_a(lambda)$ is greater than $n_b(lambda)$; i.e., those for which sin[$alpha_a+\sin^{-1}$ (sin($alpha_b-alpha_a$)/$n_a(lambda)$)] is less than or equal to $n_b(lambda)$/-$n_a(lambda)$. Accordingly, materials A and B must be selected to conform with the indicated relationship.

For a desired value "d", either $alpha_a$ or $alpha_b$ may be independently chosen, but not both. For example, if a value is chosen for $alpha_b$, then the following equation determines the required size of $alpha_a$: $alpha_a+\sin^{-1}[\sin(alpha_b-alpha_a)/n_a(lambda)]=\sin^{-1}[(n_b(lambda)/-n_a(lambda))(\sin[alpha_b-\sin^{-1}(\sin(\text{"d"})/n_b\ (lambda))])]$. Since the right side of this equation consists of known values, it may be set equal to "gamma", a know constant angle. It follows that sin ($alpha_b-alpha_a$)=$n_a(lambda)$ sin(gamma−$alpha_a$), which can be solved for $alpha_a$: $alpha_a=\tan^{-1}[(\sin(alpha_b)-n_a(lambda)\sin(gamma))/(\cos(alpha_b)-n_a(lambda)\cos(gamma))]$.

Further, for a single desired deviation or output angle "d" with two different wavelengths $lambda_1$ and $lambda_2$, angles $alpha_a$ and $alpha_b$ are determined by the specified deviation angle "d" and the values $n_a(lambda_1)$, $n_a(lambda_2)$, $n_b(lambda_1)$, $n_b(lambda_2)$, as follows:

$alpha_a=\tan^{-1}$ [(sin $alpha_b-n_a$(lambda1) sin gammal)/(cos $alpha_b-n_a$(lambda1) cos gammal)] and $alpha_a=\tan^{-1}$ [(sin $alpha_b-n_a$ (lambda2) sin gamma2)/(cos $alpha_b-n_a$(lambda2) cos gamma2)] where gammal$=\sin^{-1}$ [$n_b$(lambda1) /$n_a$ (lambda1)]sin[($alpha_b-\sin^{-1}$(sin "d"/$n_b$ (lambda1))] and gamma2$=\sin^{-1}[n_b$(lambda2) sin/$n_a$ (lambda2)]sin[-($alpha_b-\sin^{-1}$ (sin "d"/$n_b$ (lambda2))]

The simultaneous equations for $alpha_a$ and $alpha_b$ may be solved as desired. According to one technique, a numerical method can be implemented using either a computer or programmable calculator. In particular, a value is assumed for $alpha_b$; then gammal and gamma2 are evaluated; and the two equations for $alpha_a$ are finally independently evaluated and compared. Next, a new value is then chosen for $alpha_b$ which brings the two calculated values of $alpha_a$ closer together. This process is iterated until the difference between the calculated values for $alpha_a$ is sufficiently small, and is produced by similarly small differences in successively assumed values of $alpha_b$. For example, the criterion for these differences can be equal to or less than the tolerance to which such angles must be fabricated in order to produce sufficiently accurate deviation angles "d" for the required application.

Even more particularly, FIG. 6, shows a block diagram illustrating design process for choosing $alpha_a$, $alpha_b$, and material to achieve a desired deviation angle "d". This block diagram indicates the process involved in designing and making the inventive arrangement described herein.

Specifically, FIG. 6 calls for specification of a required deviation angle "d" in block 600 and making a choice of materials in block 610. Then a check is conducted at decision block 620 to see if it is possible to produce this deviation angle in a single prism of acceptable thickness with an averaged (($n_a+n_b$)/2) index of refraction value. If not, consideration is given to evaluate whether a smaller deviation value is acceptable, as suggested at block 625.

If the desired deviation angle is deemed obtainable, a check is made at decision block 630 to determine whether $n_b$ is greater than $n_a$ for both desired wavelengths. If not, flag 635 is set and the operation continues.

Next, $alpha_b$ is chosen, its absolute value being less than 90 degrees, for an acceptably thin prism. Then, the gamma values indicated above are calculated. If one or both of the gamma values is imaginary and the absolute value of $alpha_b$ is not less than or equal to the arcsine of $n_a/n_b$, another value of $alpha_b$ is chosen, as per block 640. If the $alpha_b$ chosen causes one or both of the gamma values to be imaginary and the absolute value of $alpha_b$ is less than or equal to the indicated arcsine value, or is imaginary, a smaller deviation angle must be considered.

If both gamma values are real, first and second $alpha_a$ values are calculated, and if the flag has been set earlier at block 635, a check is conducted as set forth in block 666.

If the error between the calculated values of $alpha_a$ is acceptably small, the previous value of $alpha_b$ is updated as per block 675, if this has not already been accomplished. Then the error between successive $alpha_b$ values is checked to see if it is acceptably small. In this fashion, subprism angles $alpha_a$ and $alpha_b$ can be established.

It should be understood that the invention is not limited to the particular embodiments shown and described herein, but that various changes and modifications may be made without departing from the spirit and scope of this novel concept as defined by the following claims.

We claim:

1. A multi frequency electromagnetic detection system comprising: electromagnetic transceiver means responsive to electromagnetic radiation in a radar frequency range about a frequency f1 and an optical frequency range about a frequency f2; and scanning means including cooperative first and second rotatable scanning prisms, characterized in that each of said scanning prisms comprises at least first and second subprisms each constructed of a material, having frequency-dependent indices of refraction na(f) and nb(f), respectively and having prism angles aa and ab, respectively, with the indices of refraction related by the condition that na(f1)=nb(f1) and the condition that na(f2)<nb(f2)<na(f1), and the prism angles having values such that the deviation of electromagnetic radiation passing through said scanning means is the same for frequencies substantially equal to f1 or f2.

2. A system according to claim 1 for deviating electromagnetic radiation through an angle d for each scanning prism, further characterized in that d is determined by the equation:

$$d=\sin^{-1}\{nb(f)\sin[ab-\sin^{-1}\{[na(f)/nb(f)]\sin(aa+\sin^{-1})\{\sin(ab-aa)/na(f)\})\}]\},$$

where ab is the angle of the prism having index of refraction nb and aa is the angle of the prism having index of refraction na.

3. The arrangement of claim 2, in which at least one of the frequencies scanned is infrared.

4. The arrangement of claim 2, in which at least one of the frequencies used is radio frequency.

5. The arrangement of claim 2, in which at least one of said frequencies is visible.

* * * * *